US007025072B2

(12) United States Patent
McGrath

(10) Patent No.: US 7,025,072 B2
(45) Date of Patent: Apr. 11, 2006

(54) WALKING AID

(76) Inventor: Thomas Francis McGrath, 4 Lindsay Road, Preston, Paignton, South Devon TQ3 1HL (GB)

( * ) Notice: Subject to any disclaimer, the term of this patent is extended or adjusted under 35 U.S.C. 154(b) by 94 days.

(21) Appl. No.: 10/415,925

(22) PCT Filed: Nov. 6, 2001

(86) PCT No.: PCT/GB01/04917

§ 371 (c)(1),
(2), (4) Date: May 5, 2003

(87) PCT Pub. No.: WO02/36064

PCT Pub. Date: May 10, 2002

(65) Prior Publication Data

US 2004/0035453 A1 Feb. 26, 2004

(30) Foreign Application Priority Data

Nov. 6, 2000 (GB) ..... 0027061

(51) Int. Cl.
*A61H 3/02* (2006.01)

(52) U.S. Cl. ..... 135/75; 135/82; 135/86; 280/819

(58) Field of Classification Search ..... 482/115–117; 280/819; 135/75, 82, 86
See application file for complete search history.

(56) References Cited

U.S. PATENT DOCUMENTS 1,336,844 A * 4/1920 Klousnitzer ..... 135/82
1,753,065 A * 4/1930 Payne ..... 135/82
1,839,309 A * 1/1932 Franz ..... 135/25.2
2,397,499 A * 4/1946 McGowan ..... 135/82
2,414,758 A * 1/1947 William ..... 135/82
2,856,943 A 10/1958 Sparlin
2,888,022 A * 5/1959 Fanning ..... 135/82
3,614,084 A * 10/1971 Brown
4,010,940 A * 3/1977 Freyler ..... 267/201
4,061,347 A * 12/1977 Stern et al. ..... 280/821
4,244,602 A * 1/1981 Allsop et al. ..... 280/821
4,640,211 A * 2/1987 Namur ..... 114/97
5,429,344 A * 7/1995 Stewart ..... 267/292
5,720,474 A * 2/1998 Sugiyama ..... 267/249
6,254,134 B1 * 7/2001 Panizza ..... 280/819
2001/0027802 A1 * 10/2001 McGrath ..... 135/65
2002/0053765 A1 * 5/2002 Palinkas ..... 267/294
2002/0063369 A1 * 5/2002 Huang ..... 267/153

(Continued)

FOREIGN PATENT DOCUMENTS

DE 8715707 2/1988

(Continued)

*Primary Examiner*—Robert Canfield
(74) *Attorney, Agent, or Firm*—Nath & Associates PLLC; Harold L. Novick

(57) ABSTRACT

Walking aid apparatus comprises handle portion and a shaft portion including a ground-contacting ferrule, the shaft portion comprising telescopically-mounted cylindrical spindle and sleeve elements and a spring means acting between seats of said spindle and sleeve elements resiliently to restrain relative axial sliding movement, in which the apparatus includes a sliding friction-reducing means between at least one end of the spring means and the associated seat, whereby the handle portion and the ferrule are axially rotatable to accommodate twisting movement as between the user and the ground in use. The sliding friction-reducing means results in controlled rotation as between the spring means and the spindle and/or elements with considerable benefits to the user in avoiding tortional loading to the twist, elbow and/or shoulder joints which can be especially painful to those who suffer from arthritis.

10 Claims, 6 Drawing Sheets

U.S. PATENT DOCUMENTS

2002/0170587 A1* 11/2002 Uemura ..... 135/65

FOREIGN PATENT DOCUMENTS

| | | | |
|---|---|---|---|
| DE | 41 36 210 C1 | * | 12/1992 |
| DE | 4136210 | | 12/1992 |
| DE | 41 31 330 A1 | * | 3/1993 |
| GB | 124691 | | 3/1919 |
| GB | 141596 | * | 4/1920 |
| GB | 613046 | | 11/1948 |
| GB | 2318510 | | 4/1998 |
| WO | 94/06393 | * | 3/1994 |
| WO | 00/10502 | | 3/2000 |

* cited by examiner

WALKING AID

This invention relates to walking aids with resiliently-mounted feet, intended to alleviate problems experienced by users of conventional walking aids arising from shock loading transferred to the muscles of the hands, wrists, arms and shoulders.

Physiotherapists have evidence which suggests that the muscles of the shoulder in particular and also the muscles of the hands, wrists and arms are stressed when using normal walking aids. Persons who have sustained tears of the muscles of the shoulder tend to experience difficulty when using a rigid, uncushioned walking stick, crutch or Zimmer-frame. Similarly, persons who have osteo-arthritis or rheumatoid arthritis often experience problems when using rigid support aids. Those who have hip and knee arthritis and have rotator cuff regeneration or tears in the shoulder also tend to be uncomfortable with rigid walking aids.

In order to alleviate such problems, walking aids with shock-absorbing feet have been proposed. One such device is described in GB-A-2318510, in which the foot member slides telescopically over an upper sleeve, a spring providing for resilience in the sliding movement. Another such device is described in WO 00/10502, in which it is stated to be desirable that the ground-contacting ferrule can rotate axially with respect to the shaft, in order to promote user comfort and convenience. However, it has been found in practice that freedom of rotation is dependent on the extent to which one or both ends of the spring can rotate with respect to the annular spring-contacting load-bearing area and that, in practice, such rotational movement is not smooth but on the other hand is subject, under twisting movement exerted by the user on the handle, to intermittent periods of rotational freedom separated by intervals of sticking, in which static friction and kinetic friction alternate with consequential rotational jarring experienced by the user.

In an attempt to overcome this problem, it has been proposed to introduce ball or roller bearings to enhance the freedom of rotation but it has surprisingly been found that the resulting walking aid is potentially disadvantageous or even dangerous in that, if placed on the ground at an angle to the vertical, the ferrule tends to rotate under pressure, resulting in the lower end of the shaft moving sideways and the walking aid failing to support the user's weight. It is therefore an object of the present invention to provide a walking aid with a rotatable ground-contacting ferrule which, nevertheless, provides for controlled or limited but nevertheless smoothly-operating rotation.

According to one aspect of the present invention, walking aid apparatus comprises a handle portion and a shaft portion including a ground-contacting ferrule, the apparatus comprising telescopically-mounted relatively rotatable elements and spring means acting between said elements resiliently to restrain relative compression movement, in which the bearing surfaces of the spring means and at least one element comprise sliding friction-reducing materials whereby rotation between the handle portion and the ferrule accommodates twisting movement as between the user and the ground in a controlled manner.

By "sliding friction-reducing materials" in this specification is meant a materials couple which reduces the friction between at least one end of the spring means and the associated element, relative axial rotation being accommodated by sliding movement therebetween. It has been found that the use of sliding friction-reducing materials results in controlled rotation as between the spring means and at least one of the telescopic elements with considerable benefits to the user in avoiding tortional loading to the wrist, elbow and/or shoulder joints which can be especially painful to those who suffer from arthritis, without the disadvantages arising from uncontrolled rotation such as results from the use of ball or roller bearings.

The bearing surface of the at least one element which is capable of axial rotation relative to the spring means may be an integral part of the element itself or alternatively may comprise a separate friction-reducing element having a spring-contacting surface and an oppositely-facing surface which bears against a seat of said element, rotational sliding movement taking place between the spring means and the separate element and/or between the separate element and the seat. The sliding friction-reducing element preferably comprises an annular washer which may be configured as a cup washer, the cup comprising the spring-facing surface and a peripheral wall to encompass the extremity of the spring means. The material from which the sliding friction-reducing element is formed should preferably be sufficiently hard to be accurately machined with a substantially flat seat-facing area while providing for the required degree of friction with the other material of the couple to give controlled rotation under load conditions. Suitable materials include engineering plastics materials such as acetal-type copolymers which may optionally be glass- or fibre- reinforced. However, the choice of material is to some extent governed by the diameter of the ferrule or at least the ground-contacting lower surface thereof, since a larger-diameter ferrule will have a greater resistance to twisting movement on the ground and, hence, a material with less inherent lubricitiy is preferred for the friction-reducing means, in order to provide the desired controlled rotation. Where the seat of the telescopic element bears directly on the spring means, similar criteria as to the choice of materials apply.

The telescopically-mounted relatively rotatable elements typically comprise an outer sleeve element and an inner spindle element, the elements being capable both of relative axial sliding movement to accommodate compression and expansion as a load, is applied to or released from the handle portion of the apparatus and of relative axial rotation to accommodate twisting movement as between the user and the ground in use.

The spring means may be any resilient element and may comprise for example a helical spring, a pneumatically- or hydraulically-controlled strut or a resilient elastomeric material; conventionally, a helical stainless steel spring is used but other resilient materials or assemblies may equally be used in the inventive apparatus. The inner or spindle telescopically-mounted element may have an inner co-axial neck portion of reduced diameter, an annular gap being defined between the neck portion and the sleeve element and which accommodates the spring means which, conveniently, comprise a helical spring. However, in another arrangement, the inner telescopically-mounted element has an inner end face which bears, directly or via a friction-reducing element, on one end of the spring means. In such an arrangement, the spring means may comprise a block, typically a cylindrical block, of resilient elastomeric material, although one or more spherical, spheroidal or ellipsoidal blocks may be used, preferably two such blocks of respectively different resilience or selected from blocks of different resilience to vary the force required to compress the elements. Thus, for example, spheres may be selected from hard (H) and soft (S) resilient materials and compressibility may be varied by using H-H, H-S or S-S combinations although preferably at least one hard element is used to render the extent of controlled rotation to be substantially independent of applied compression forces. In yet another arrangement, the spring means bears directly on the ferrule or is integrally formed with the ferrule from a suitable elastomeric material. The spring means is preferably pre-loaded so that, even when in the fully-extended position of the telescopically-mounted elements, the spring means nevertheless remains partially compressed, thereby causing the apparatus to exhibit the controlled rotation property under a no-load or very light loading exerted on the apparatus through the handle portion.

Preferably, the apparatus includes cylindrical bushes journalled between the cooperating axially-slidable surfaces of the telescopically-mounted elements, the bushes enhancing the relative axial sliding movement and optionally assisting to a lesser extent in the controlled rotation. The bushes are preferably formed from a suitable plastics material which may comprise nylon or an engineering plastics as in the case of the sliding friction-reducing element.

The use of a pneumatically- or hydraulically-controlled strut, for example a nitrogen-damped cylinder and piston, for the spring means is advantageous in that the damping force may be adjusted according to the weight of the, user by pre-loading to a particular desired gas pressure, for example by the physiotherapist. The ability to increase or decrease the pressure enables stocks of a single unit to be maintained, to be selectively adapted to the requirements of the individual user at the time of supply.

In an alternative way of pre-loading the spring means, the distal end of the inner telescopically-mounted element may comprise a screw-threaded portion carrying a lock nut which bears on the outer element to adjust its position relative to the inner element, thereby compressing the spring means. The distal end of the outer element may have a counter-bore to accommodate the lock nut; the open end or mouth of the counter-bore may accommodate resilient damping means to act as a cushion for the distal end of the inner element and lock nut on full-load compression of the spring means. Additionally, the proximal end of the outer element, which in use accommodates the spring means, may be formed with an annular groove formed in the wall thereof and which carries a resilient O-ring, preferably supported on an inner-extending shoulder constituted by one wall of the groove. Where the inner element comprises a smaller-diameter neck portion extending co-axially of the cylindrical portion for carrying the spring means and the pre-loading lock nut, an annular shoulder is defined between the cylindrical portion and the neck portion and which makes contact with the O-ring at the position of maximum compression movement while still retaining the ability for controlled rotation. Desirably, where cylindrical bushes are contained in such an arrangement, they are journalled at the proximal end between the cylindrical portion and the inner-facing wall of the sleeve element and at the distal end between the plain part of the neck portion and a smaller-diameter portion of the sleeve element.

The sub-assembly comprising the telescopically-mounted elements and spring means may be carried, in walking aid apparatus according to the invention, either towards the ferrule end or towards the handle portion end, or indeed at any intermediate location. It has been found in practice, particularly for use by people who are relatively infirm, that provision of the sub-assembly close to the handle portion gives a greater sense of control and hence a greater sense of security.

The shaft portion of waling aid apparatus according to the invention may comprise an aluminium tube, as in many walking sticks or Zimmer-frames used by people under medical supervision, but may equally be a conventional solid, for example wooden, shaft, since the invention provides benefits to walking aids such a conventional walking sticks where there is no particular medical condition which requires the use thereof. When used with a metal tubular walking aid, the inner element may be mounted in the tube, whether at the top or bottom thereof, by means of an arrangement as described in WO 00/01502 and comprising grip means for inhibiting or preventing removal from the shaft once attached thereto. Particularly when attached to the upper end of the shaft, both the inner and outer elements may be carried respectively in a cylindrical tube attached to the handle and to the cylindrical shaft using a grip means such as described in WO 00/01502. Plastics materials may also be used for the shaft and/or for one or all of the components of the telescopically-mounted sub-assembly, provided that the required degree of controlled rotational ability is exhibited as a function of the frictional forces between the rotational bearing surfaces.

In order to avoid any possibility of a pinching movement as between the outer telescopically-mounted element and the shaft or handle portions in a position at or approaching maximum compression thereof at least one of the facing edges of the outer element and the shaft or handle portions, preferably both, may be provided with a chamfer so that, even when fully compressed, there remains an annular V-shaped gap between the outer walls thereof.

Embodiments of the invention will now be described by way of example with reference to the accompanying drawings of which:

Figure 1:
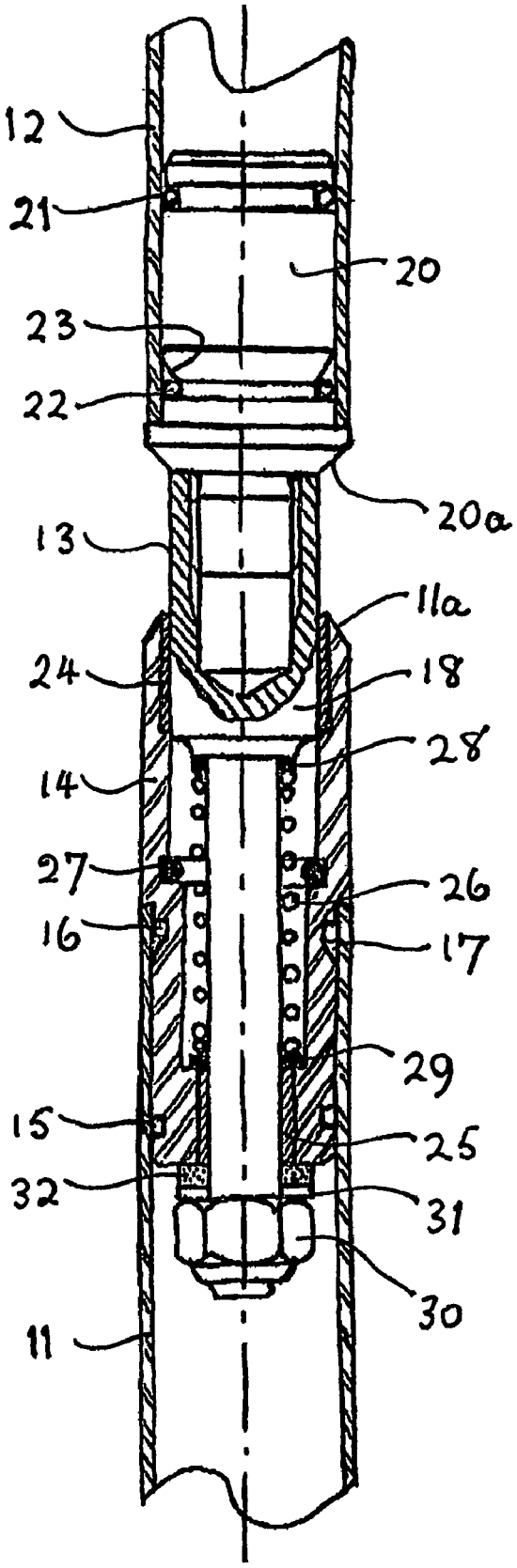
FIG. 1 shows the general assembly of apparatus according to the invention for fitting to the upper or lower section of a walking aid and containing a helical spring.

Referring firstly to FIG. 1, a lower part 11 of the hollow shaft of a walking aid is attached to an upper part 12 of the shaft via a telescopically-mounted spindle element 13 and a sleeve element 14. The sleeve element is carried in the upper end of the shaft 11 and is held therein by rubber O-rings 15, 16 carried in annular grooves, the groove which accommodates O-ring 16 having a lower chamfered wall 17, whereby the ring 16 is forced into jamming engagement with the inner wall of the shaft 11 on any attempted withdrawal of the sleeve element 14 from the shaft, thereby preventing such withdrawal. The spindle element 13, about which the sleeve element can rotate, consists of a spindle body 18, a neck 19 and a base 20, the base being similarly inserted in the lower end of the shaft 12 and retained therein by O-rings 21, 22 carried in annular grooves, the lower groove which accommodates ring 22 having an upper chamfered wall 23. The upper end of the shaft 11 is formed with a sloping edge 11*a* and, similarly, the lower-facing edge of the base 20 of the spindle element is formed as a sloping shoulder 20*a*.

The spindle element is journalled for axial sliding movement in the sleeve element by means of annular bushes 24, 25 and a helical spring 26 extends between an upper shoulder formed between the body 18 and neck 19 of the spindle element and an inner shoulder at the lower end of the sleeve element. An O-ring 27 is carried in an inner-facing intermediate annular groove in the sleeve element and serves as a resilient buffer for contact with the upper shoulder on maximum depression of the spindle element within the sleeve element.

At each end of the spring 26 and journalled respectively between the machined ends of the coils thereof and the upper and lower shoulders are sliding friction reducing clutch washers 28, 29 formed from an acetal copolymer. The spindle element 13 is retained within the sleeve element 14 by a Nyloc nut 30 applied to the lower screw threaded end of the neck 19 and bearing against the lower annular surface of the sleeve element via a nylon washer 31 and a rubber washer 32.

In the position shown in FIG. 1 with the spindle element at its position of maximum extension within the sleeve element, the spring 26 still exerts pressure as between the respective elements through the clutch washers 28, 29. The clutch washers enable smooth relative axial rotation as between the respective elements and, therefore, between the shaft parts 11, 12, avoiding on the one hand intermittent grip and release which would otherwise occur from direct metal-to-metal contact between the ends of the spring and the respective shoulders while, on the other hand, preventing uncontrolled or excess rotation. A similar effect is achieved when compression pressure is applied by a user so that the spindle element slides within the sleeve element against the pressure exerted by spring 26 until, at the position of maximum compression, the upper shoulder is in contact with O-ring 27. At this position, the sloping ends 11*a*, 20*a* of the shaft 11 and base 20 of the spindle element 12 are in abutting relationship, the sloping surfaces preventing any possibility of the user's skin or clothing being pinched between the ends of the shafts.

Figure 2:
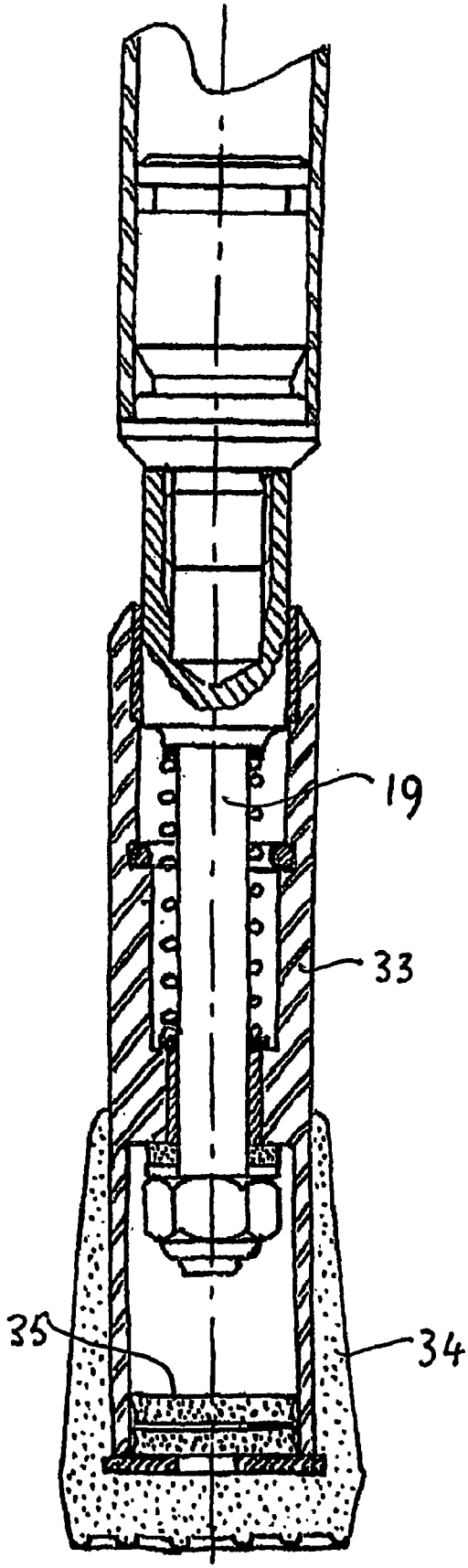
FIG. 2 shows the assembly of FIG. 1 attached to the lower end of a walking aid the shaft of which has a hollow metal tube.

With reference to FIG. 2, an arrangement similar to that described with reference to FIG. 1 is shown but the sleeve element 33 constitutes the lower end of the shaft of the walking aid and carries a rubber ferrule 34. Resilient disks 35 are carried at the lower end of the sleeve element 33, to act as a bump-stop for the end of the neck portion 19 of the spindle element.

Figure 3:
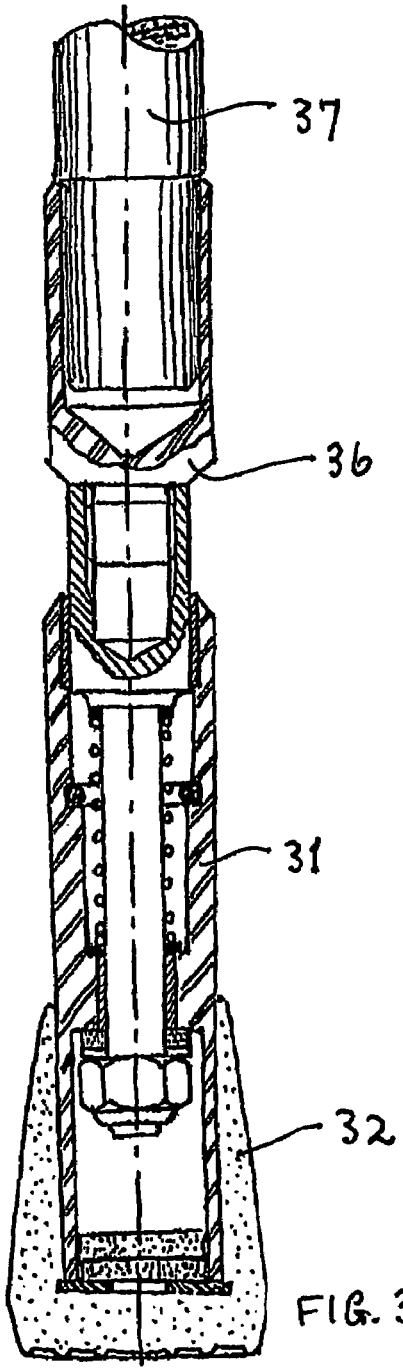
FIG. 3 shows the assembly attached to the lower end of a conventional wooden walking stick.

FIG. 3 shows an arrangement similar to that described with reference to FIG. 2 but the upper end of the spindle element is formed as a hollow, blind-ended cylinder 36 which receives the lower end of a solid shaft 37 of a walking aid.

Figure 4:
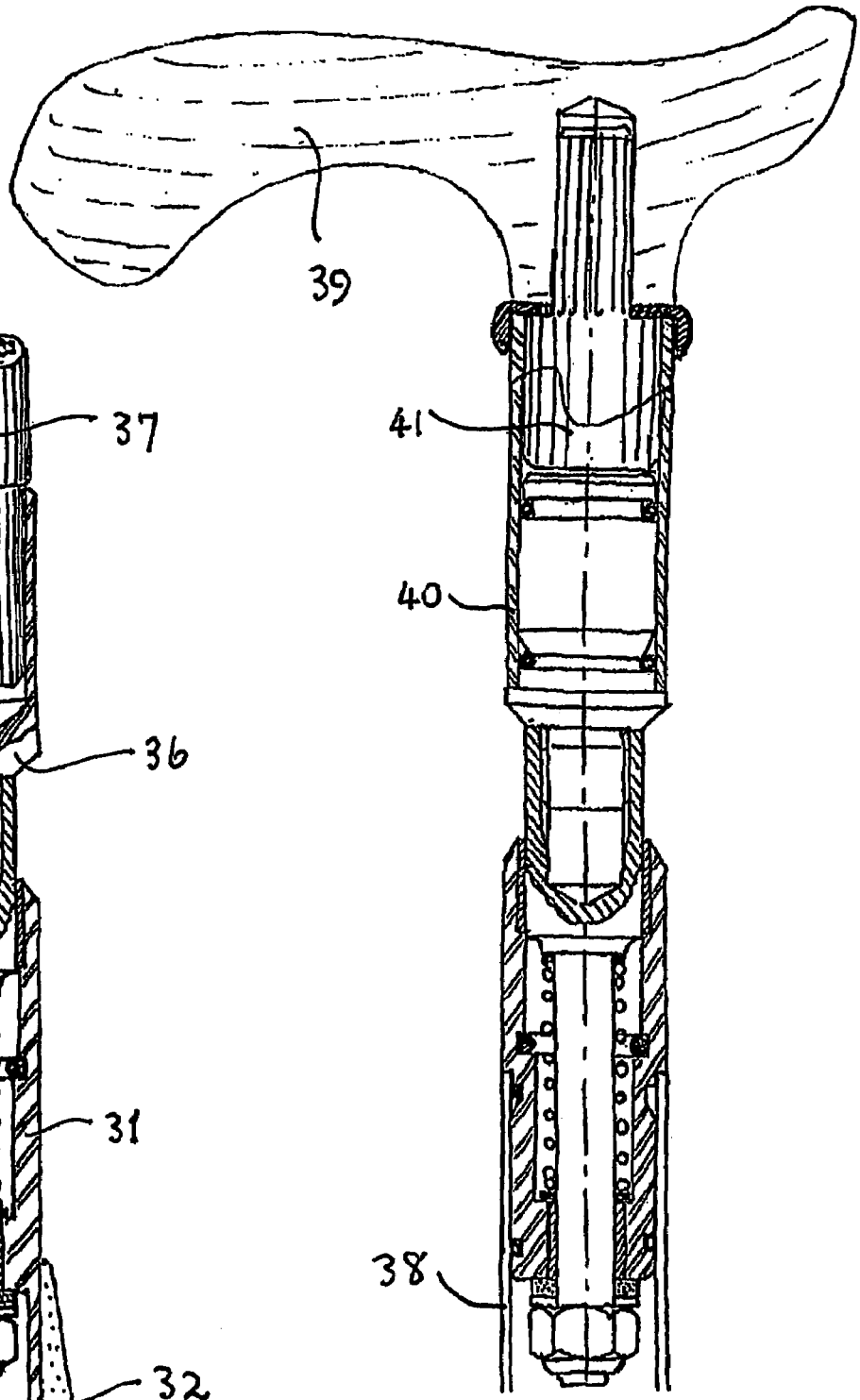
FIG. 4 shows the assembly as attached to the upper end of a walking aid having a hollow metal shaft.

FIG. 4 illustrates a further embodiment in which the spindle element/sleeve element assembly is carried at the upper end of a walking stick shaft 38, immediately beneath the handle 39. The upper end of the spindle element is secured, in a manner similar to that described with reference to FIG. 1, in the lower end of a short piece of tubing 40, the upper end of which carries a splined element 41 secured within a cavity formed within the handle 39.

In the embodiment illustrated, hollow shafts are formed from aluminium and solid shafts are formed from wood; the respective spindle and sleeve elements are formed from aluminium, although the sleeve element may be made from stainless steel. In a further embodiment, the arrangement as described with reference to FIG. 2 could be inverted so that the ferrule is attached to the enlarged body part of the spindle element and the sleeve element is held within the lower part of the shaft of the walking aid with the lock nut facing upwardly in the shaft.

As shown in the embodiments illustrated in FIGS. 1 to 4, the base of the spindle element is preferably adapted to receive a connector part either for fitting within the shaft of a walking aid or around the lower end thereof, or to which a ferrule may be directly attached. As illustrated, the base of the spindle element is formed with an axial cavity to receive the spigot or stub end of the connector part, although the connector part could equally include a cavity to receive a spigot or stub end of the spindle element.

Figure 5:
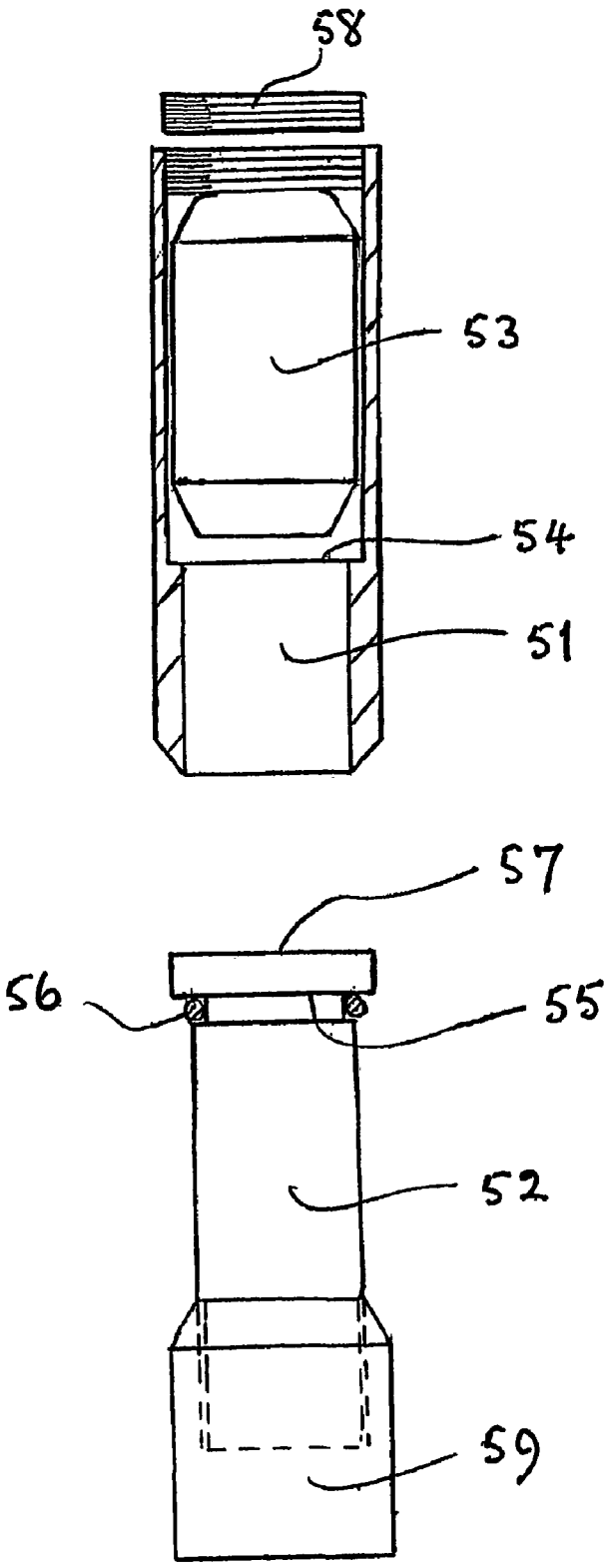
FIG. 5 shows an embodiment with a compressible rubber spring.

With reference to FIG. 5, a sub-assembly suitable for fitting to the upper or lower end of a walking stick shaft consists essentially of a cylindrical sleeve 51, a piston or plunger body 52 for fitting within the sleeve and a resilient cylindrical rubber block 53 carried within the cavity of the sleeve. Once assembled, the plunger body is held captive within the sleeve by co-operating inner and outer annular shoulders 54, 55; an O-ring 56 is provided in a groove below shoulder 55 to act as a resilient buffer under maximum extension of the plunger with respect to the sleeve. The lower end of the rubber block 53 bears against the upper end surface 57 of the plunger body and the upper end of the block bears against and is retained by a disc 58 screw-threadedly engaged in the upper end of the sleeve 51.

A ferrule (not shown) may be attached to the foot 59 of the plunger which, as shown, is screw-threadedly attached thereto after insertion from above of the plunger body. The sleeve and plunger may be formed from a plastics material such as polypropylene or polybutylene. The foot of the plunger may of course be attached to the plunger body by means other than screwing, such as by the use of a glue or a solvent for plastics materials, thus welding them together.

In use, the plunger body is axially rotatable within the sleeve but is restrained from uncontrolled rotation by frictional forces between the mating surfaces of the rubber block 53 and the plunger body.

Figure 6:
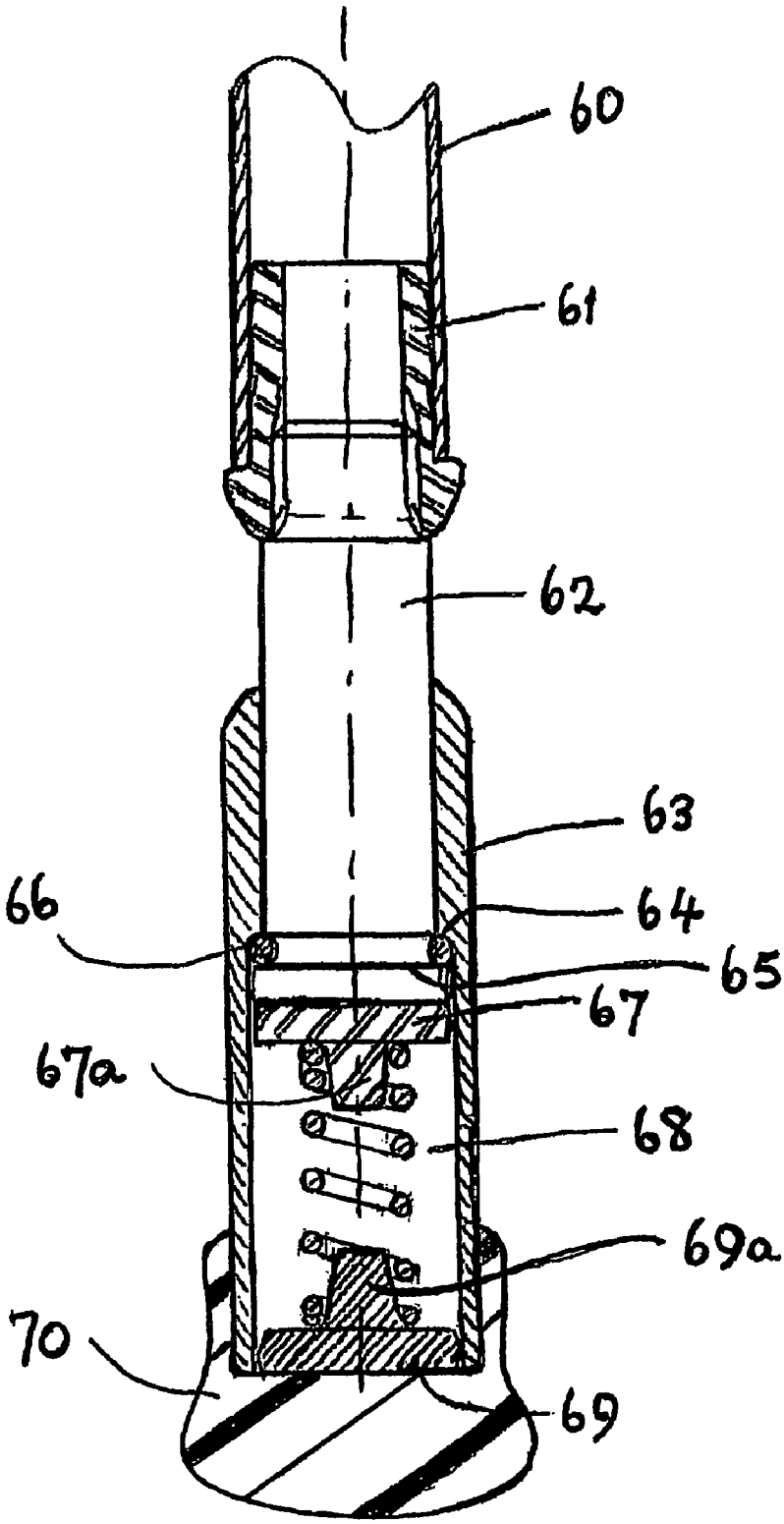
FIG. 6 shows another embodiment.

Referring to FIG. 6, another embodiment of a sub-assembly fitted to the lower end of a tubular shaft 60 consists of an adapter 61 fitted within the lower end of the shaft end a piston or plunger 62 secured within and extending axially from the adapter. The plunger 62 slides within a cylindrical sleeve 63 and is held captive therein by cooperating inner and outer annular shoulders 64, 65 via O-ring 66. A clutch washer 67 is provided at the lower end of the plunger for mounting one end of a spring 68, the other end being retained by plug 69 retained at the bottom of the sleeve 63. A ferrule 70 is carried at the lower end of the sleeve 63. The spring may be a helical spring located between respective spigots 67*a*, 69*a*; in an alternative arrangement, the clutch washer can be formed without the spigot 66*a* or omitted altogether, the spigot 69*a* can be omitted and the spring could be a resilient cylindrical rubber material or, in yet a further alternative arrangement, the spring in the form of a resilient rubber material could be integrally formed with the ground-contacting ferrule, as an insert neck thereof in the lower end of the sleeve 63 and bearing on clutch plate 67 or directly on the lower face of the plunger 62.

Figure 7:
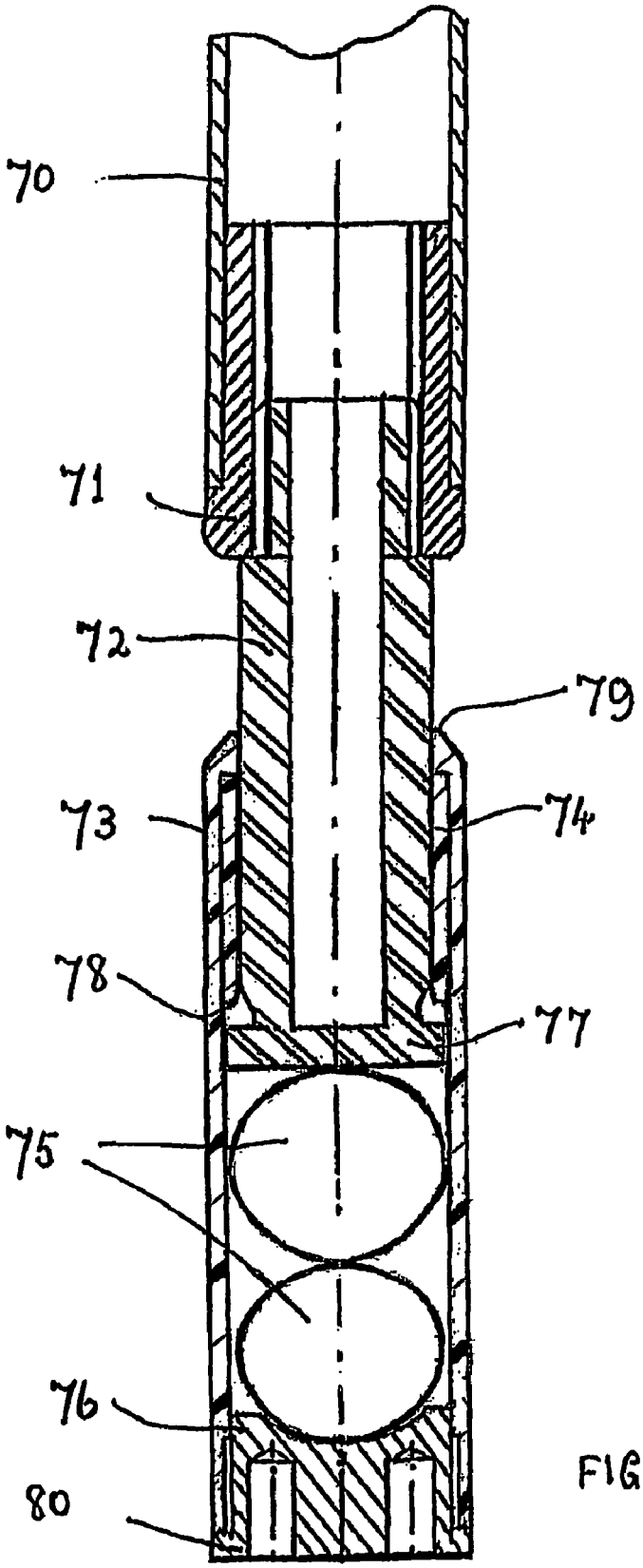
FIG. 7 shows an embodiment with compressible elastomeric spheres.

Referring to FIG. 7, a further embodiment using elastomeric spheres is shown, in which the components are moulded from fibre-reinforced nylon such as nylon 66. The sub-assembly is secured to the lower end of a standard aluminium shaft 70 via a moulded socket 71 to which a depending plunger 72 is screw-threadedly attached. The plunger is slidingly journalled in base sleeve member 73 via a cylindrical bush 74 and bears on the upper of two elastomeric rubber spheres 75, the lower of which is carried in an optional shallow depression formed in the upper surface of a plug 76 which is carried in the lower end of the sleeve member and to which a ferrule (not shown) is attached. Optionally, the contact surface of the plunger 72 is formed with a slight concavity or depression to correspond with or provide a curved receiving surface for the upper sphere. The position of maximum extension of the plunger 72 within the sleeve member 73 is determined by the radially-extended flange 77 of the plunger contacting the lower edge 78 the bush 74, itself retained within the upper part of the base sleeve member 73 by engagement between the upper end of the bush 74 and an inner flange 79 of the sleeve member 73. The upper of the two spheres 75 is formed from a denser, that is, less resilient, elastomeric material than the lower sphere. The sub-assembly is shown under slight axial compression loading.

The contacting surfaces of the upper of the elastomeric spheres 75 and the plunger 72 provide for controlled axial rotation, the resistance of which is substantially independent of the compression loading on the spheres, while the lower sphere, compressing more than the upper sphere with increasing compression forces increases the contact area between the lower sphere and the surface of the depression with increasing compression loading and resists rotation. The plug 76 has a flange 80 which limits the extent to which the plug can be screwed into the lower end of the sleeve member 73.

Figure 8:
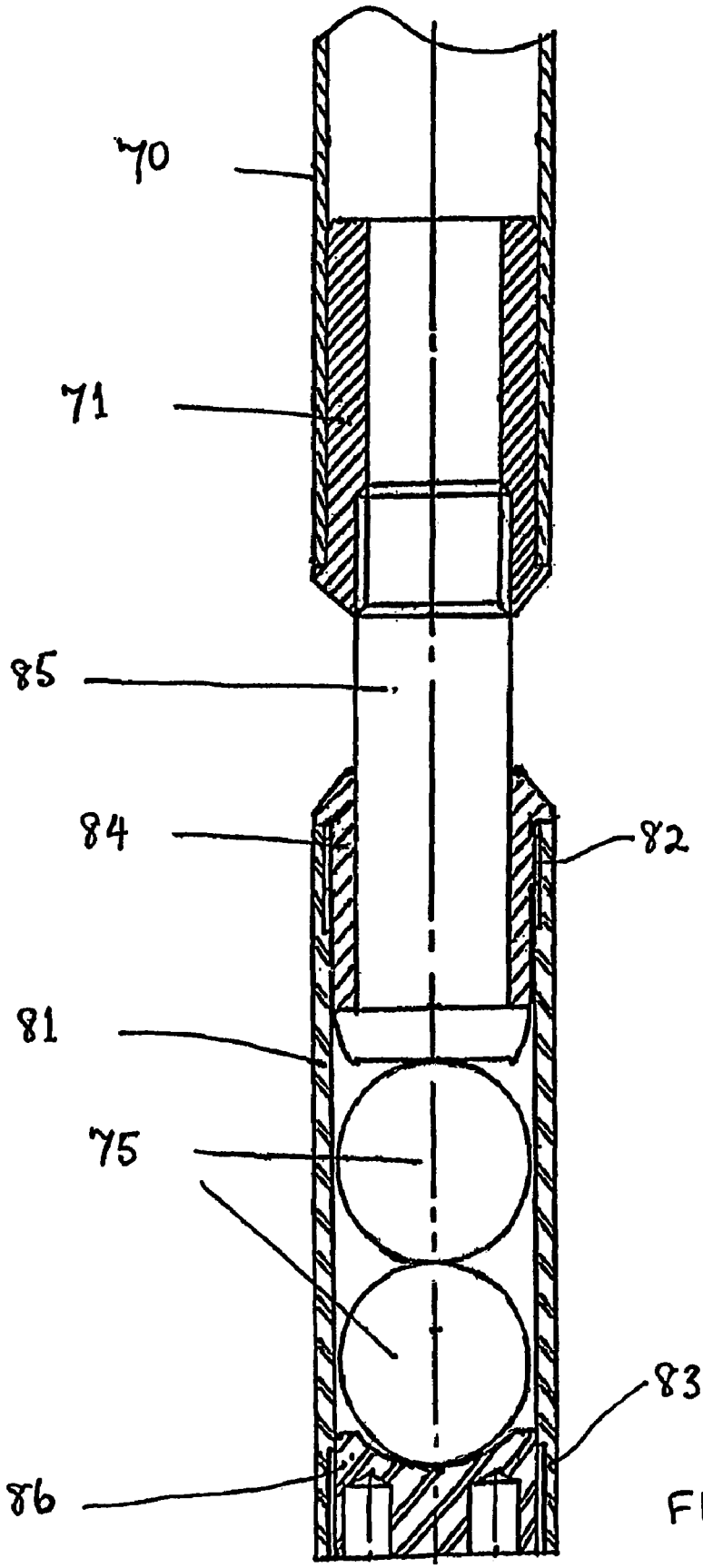
FIG. 8 shows another embodiment with elastomeric spheres.

With reference to FIG. 8, the sub-assembly is similar to that described with reference to FIG. 7 in the use of elastomeric spheres but the base sleeve member 81 is formed from aluminium tubing, screw-threaded end regions 82 and 83 being provided for attachment of an inner sleeve 84, in which the plunger 85 is journalled, and the lower plug 86, respectively. In this embodiment, the tubing is of 19 mm diameter, although tubing of larger diameter, say 22 mm, may alternatively be used. The plug 86 is unflanged and may thus be screwed as far as necessary within the lower end of the sleeve member to adjust the axial dimension of the chamber for housing the spheres and, hence, the unloaded pressure (if any) on the spheres.

What is claimed is:

1. Walking aid apparatus comprising a handle portion and a shaft portion including a ground-contacting ferrule, the handle and shaft portions comprising telescopically-mounted relatively rotatable elements, said shaft portion comprises a tube and the inner or the outer telescopically-mounted element is mounted to the tube by a grip arrangement comprising an O-ring carried in an annular groove formed in the element and having a chamfered wall, whereby the ring is forced into jamming engagement with the inner wall of the shaft portion on any attempted withdrawal of the element from the shaft portion;

and including spring means resiliently to restrain relative compression movement, characterized in that the spring means comprise a resilient elastomeric material which is rotatable relative to at least one said element, whereby rotation between the handle portion and the ferrule accommodates twisting movement as between the user and the ground in a controlled manner.

2. Apparatus according to claim 1, in which a friction reducing element is interposed between at least one element and said elastomeric spring means.

3. Apparatus according to claim 1, in which the spring means comprises one or more spheroidal elastomeric elements.

4. Apparatus according to claim 1, the apparatus including cylindrical bushes journalled between the telescopically-mounted elements.

5. Apparatus according to claim 1, in which the inner-telescopically-mounted element has an inner end face which bears against the elastomeric spring means.

6. Apparatus according to claim 1, in which the telescopically-mounted elements and spring means comprise a sub-assembly which is carried either towards the ferrule end or towards the handle portion end of the apparatus.

7. Apparatus according to claim 1, and further comprising an outer element having a facing edge and the handle and shaft portions each having a facing edge, wherein at least one of the handle portion or of either the facing edge of the outer element or the facing edge of the shaft portion is provided with a chamfer.

8. Sub-assembly for attachment to walking aid apparatus that includes a handle portion, a shalt portion and a ferrule and comprising telescopically-mounted relatively rotatable inner and outer elements;

a tube, one of the inner or the outer telescopically-mounted element is mounted to the tube by a grip arrangement comprising an O-ring carried in an annular groove formed in the element and having a chamfered wall, whereby the ring is forced into jamming engagement with the inner wall of the shaft portion on any attempted withdrawal of the element from the shaft portion; and spring means acting between said elements to restrain relative compression movement, in which the spring means comprises a resilient-elastomeric material which is rotatable relative to at least one said element whereby rotation between the handle portion and the ferrule accommodates twisting movement as between the user and the ground in a controlled manner.

9. A sub-assembly according to claim 8, in which one of the telescopically-mounted elements is adapted for engagement with a connector part for engagement either within the end portion of a hollow walking aid shaft or around the end portion of a solid walking aid shaft.

10. In combination, a walking aid apparatus having a handle portion, a ground-contacting ferrule, and a shaft that is either hollow or solid connecting said handle portion and said ferrule; and telescopically-mounted relatively rotatable elements and an elastomeric spring means acting between seats of said elements resiliently to restrain relative compression movement, and a connector part adapted for engagement either within the end portion of a hollow walking aid shaft or around the end portion of a solid walking aid shaft, characterised in that the spring means comprise a resilient elastomeric material which is rotatable relative to at least one said element, said connector part comprises a tube and the inner or the outer telescopically-mounted element is mounted to the tube by a grip arrangement comprising an O-ring carried in an annular groove formed in the element and having a chamfered wall, whereby the ring is forced into jamming engagement with the inner wall of the connector part on any attempted withdrawal of the element from the shaft portion, whereby rotation between the handle portion and the ferrule accommodates twisting movement as between the user and the ground in a controlled manner.

* * * * *